United States Patent [19]

Carolan

[11] 4,114,203

[45] Sep. 19, 1978

[54] WATER CLOSET TANK DRAIN VALVE

[75] Inventor: Raymond Jerome Carolan, Seattle, Wash.

[73] Assignee: The Boeing Company, Seattle, Wash.

[21] Appl. No.: 818,027

[22] Filed: Jul. 22, 1977

[51] Int. Cl.[2] ..... E03D 1/00; E03D 3/00; E03D 5/00

[52] U.S. Cl. ..... 4/317; 4/323; 4/372; 4/48; 4/50; 4/375; 4/115; 4/249; 137/577

[58] Field of Search ..... 4/1, 8, 12, 76, 79, 4/77, 78, 81, 90, 89, 95, 111, 115, 52, 114, 249, 48, 47, 42, 50, 49

[56] References Cited

U.S. PATENT DOCUMENTS

| | | | |
|---|---|---|---|
| 1,364,309 | 1/1921 | Popp | 4/48 |
| 2,099,631 | 11/1937 | Sarra | 4/47 |
| 2,122,909 | 7/1947 | Eganas | 4/47 |
| 3,454,967 | 7/1969 | Corliss | 4/77 |
| 3,593,346 | 7/1971 | Katona | 4/10 |
| 3,662,888 | 5/1972 | Kemper | 4/10 X |

*Primary Examiner*—Henry K. Artis
*Attorney, Agent, or Firm*—H. Gus Hartmann; Bernard A. Donahue

[57] ABSTRACT

A self-contained, recirculating flush liquid, type of water closet for passenger aircraft; wherein, the means for periodically draining the contents of the waste holding tank, comprises an inverted U-shaped tube which is separated at the bend of the U-shape or elbow thereof, into approximately two half-parts. These half-parts are joined by a movable or flexible connection in order that one of the half-parts can be moved relative to the other half-part. One end of the U-shaped tube is rigidly fixed to and projects out from the bottom of the tank; and the other movable half-part has an intake nozzle opening which when it is positioned at the bottom surface of the tank, it is at an operative waste removal position, and when it is moved to a raised position where the intake nozzle opening is at the top of the tank, the removal of waste from the tank is prevented.

6 Claims, 5 Drawing Figures

WATER CLOSET TANK DRAIN VALVE

BACKGROUND OF INVENTION

The present day commercial jet airliner utilizes a toilet waste system comprising a waste holding tank with a drain valve mounted in the bottom thereof, and flushing the toilet bowl with recirculating liquid.

Servicing of the toilet waste system is accomplished through a service panel which interconnects with the drain valve of the holding tank through a nominal four-inch diameter drain line. For servicing, a hose from a ground service tank truck is connected to the service panel, waste drain line connection; and the drain valve is opened by the service attendant pulling on a drain valve control handle. The toilet waste is drained by gravity from the waste holding tank through the drain line and over the airport ramp to be deposited into the ground service tank truck. After draining of the waste holding tank, for a cleansing action, water from the ground service tank truck is pumped into the tank through a flush connection on the service panel; and then, a small amount of pre-charge liquid is added and left in the waste holding tank for initiating toilet flushing action.

One of the problems with aircraft toilets has been caused by drain valve leakage; and the most frequent cause of this leakage has been due to particles of debris becoming trapped between the rubber drain valve and the valve seat, when it closes. This allows the liquid in the waste holding tank to drain into a four-inch diameter drain line which generally connects with the service panel. Now, if the hinged cap on the waste drain line connection at the service panel, seals the drain line tightly and does its job, then the only problem that a leaking rubber drain valve could cause, would be to permit the liquid from the waste holding tank to drain into the four-inch diameter drain line. However, some of the drain line installations of the larger type of commercial passenger airplanes, such as the Boeing 747, are of sufficient length so that the liquid level in the toilet bowl lowers to a level where the flushing action becomes inoperative. Another problem occurs when there is leakage from the hinged cap on the waste drain line connection at the service panel; because, the toilet waste liquid, which is very corrosive, leaks to the outside of the airplane and corrodes the exterior aluminum skin. Also, when this leakage occurs at high altitude, the liquid freezes onto the exterior surfaces of the airplane and keeps building up into large chunks of "Blue-Ice". The color is due to the blue dye additive in the waste holding tank which is utilized for masking the color of the waste matter. When this Blue-Ice becomes relatively large, or when the airplane descends to warmer air at a lower altitude, such as entering into a landing pattern, then this Blue-Ice becomes dislodged. There have been numerous incidents of damage to the airplane itself, from this Blue-Ice striking the leading edge of the wing and empenage surfaces, and being ingested into aft mounted engines. Also, there have been incidents of the falling Blue-Ice causing property damage.

Waste drain valve leakage, has been a problem to the airlines for a long time; and it is basically true, that if more servicing attention were given to the existing toilet systems and more preventive maintenance were performed, such as replacing the rubber drain valves, then the system would provide good service without leakage. However, the facts of the matter are, that this is not always done and some debris does become trapped under the rubber drain valve. The problem is, that when the drain valve does leak, it fills up the drain line with liquid waste all the way to the hinged cap at the service panel. Then, when the service attendant removes the cap for a servicing hook-up, he is inundated by the liquid waste and it also spills onto the airport ramp. This upsets everyone, including the airport authorities; and as a result of this, some of the airports in this country have legislated the use of a device known as a "Do-Nut". This Do-Nut comprises a rubber ring which is mounted onto an expandable metal hoop and requires a special fixture for inserting and removing it from the interior of the drain line in the vicinity of the hinged cap cover. The Do-Nut functions somewhat similar to that of an expandable rubber stopper on a thermos bottle. The Do-Nut, which is a loose item, occasionally gets lost or is thrown away; and the annual replacement cost to the airlines runs into the thousands of dollars. It also is prone to leakage; however, if it is used as directed, it does solve the problem of having the entire length of drain line emptying onto the airport ramp. Even if it does leak slightly, as long as it remains in position, only a small amount of liquid that is trapped between it and the removable cap cover, would spill out. However, this Do-Nut still doesn't solve the Blue-Ice problem at high altitude, where the pressure differential between the waste holding tank and the atmosphere forces liquid leakage into the drain line, past the Do-Nut and cap-cover seal, and onto the exterior skin surface of the airplane.

Therefore, the object of this invention is to solve these problems regardless of how good or how bad the toilet waste system is serviced.

SUMMARY OF THE INVENTION

The invention relates to a toilet tank waste removal system which is designed to replace the existing system used on the present day commercial jet transport aircraft and more particularly, to a toilet tank drain valving system that can be drained by gravity action or by applying a suction to the drain line by vacuum ground servicing equipment. By moving the sealing point of the waste tank drain intake opening from the bottom of the tank to the top of the tank, the sealing characteristics of the drain valve are no longer critical. Also, it it no longer necessary to renew the tank with a predetermined or metered amount of liquid pre-charge in order to prevent overflow of the tank by the person servicing it. These and other advantages of the invention will be more clearly understood hereinafter.

DESCRIPTION OF THE PREFERRED EMBODIMENTS

FIGS. 1 to 4, show a first embodiment of the drain valve mechanism for the toilet tank drainage system of the present invention.

Figure 1:
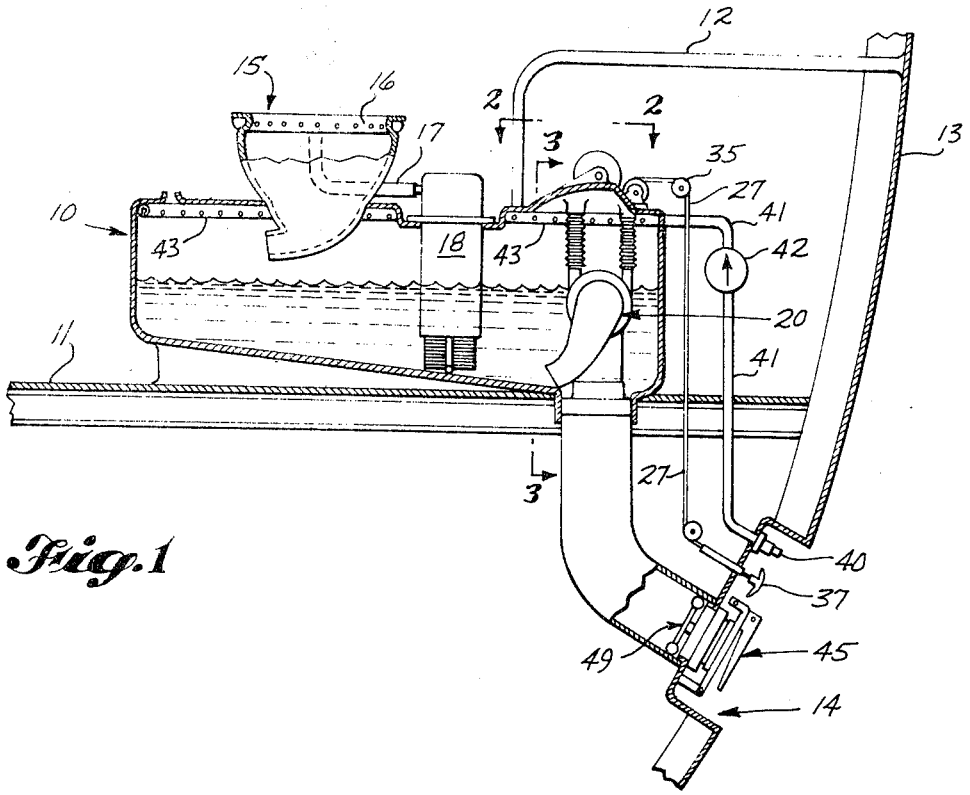
FIG. 1 is a side cross-sectional assembly view of a self-contained, recirculating flush liquid, type of water closet, embodying the inverted U-shaped tubular member constituting the drain valve apparatus of the present invention.

FIG. 1 is a side assembly view of the waste system mounted within the cross-section of an aircraft fuselage. The waste holding tank 10 is supported by the fuselage floor 11 and vented to atmosphere through an overboard vent line 12 to outside of the fuselage hull 13. Servicing of the waste holding tank 10 is done externally of the fuselage and is performed from the service panel 14 which is flush mounted in the fuselage hull 13 and located below the floor 11 supporting the waste holding tank 10.

The waste system comprises a toilet bowl 15 mounted onto the waste holding tank 10. The toilet bowl 15 has a spray ring 16 located around the upper inner periphery for ejecting flushing liquid to wash the waste down from the sides of the bowl; and the spray ring 16 is connected through flush line 17 to a pump and filter assembly 18 which provides the recirculating filtered flushing liquid.

Figure 2:
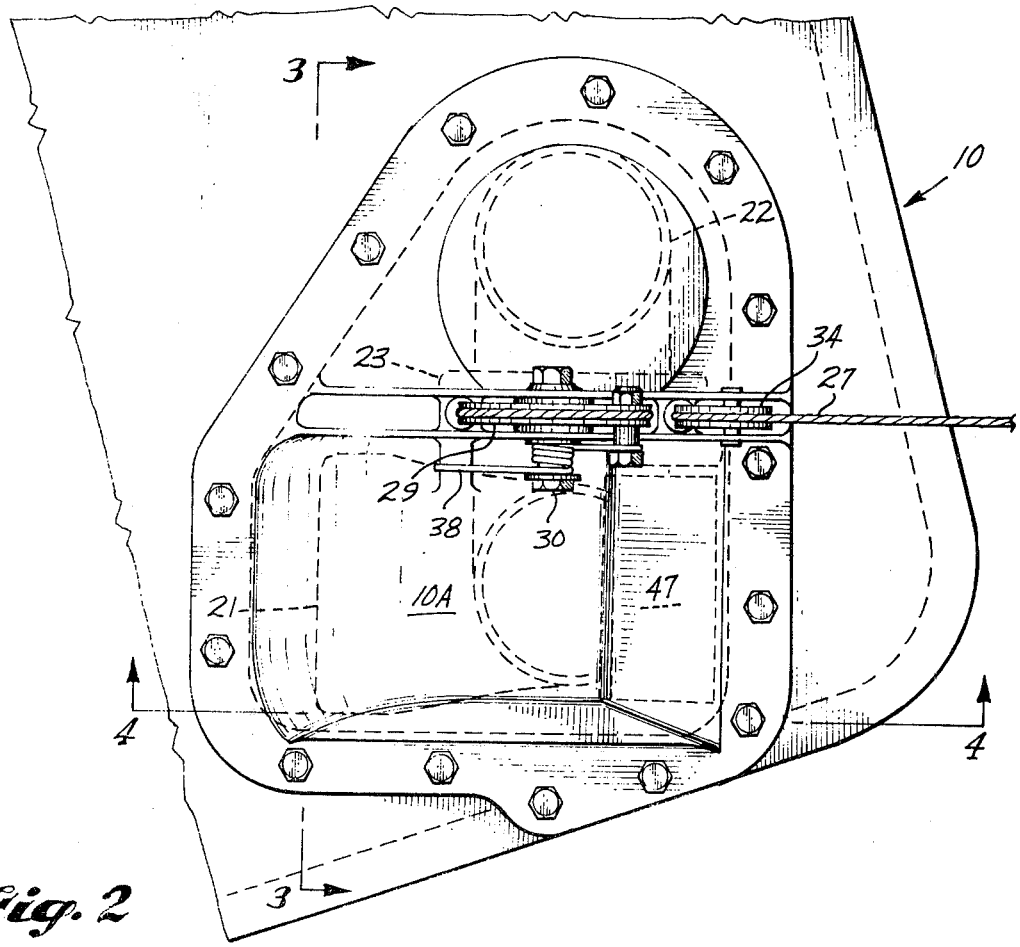
FIG. 2 is an enlarged plan detail view of the inverted U-shaped drain valve mechanism taken in the direction 2—2 indicated in FIG. 1.
Figure 3:
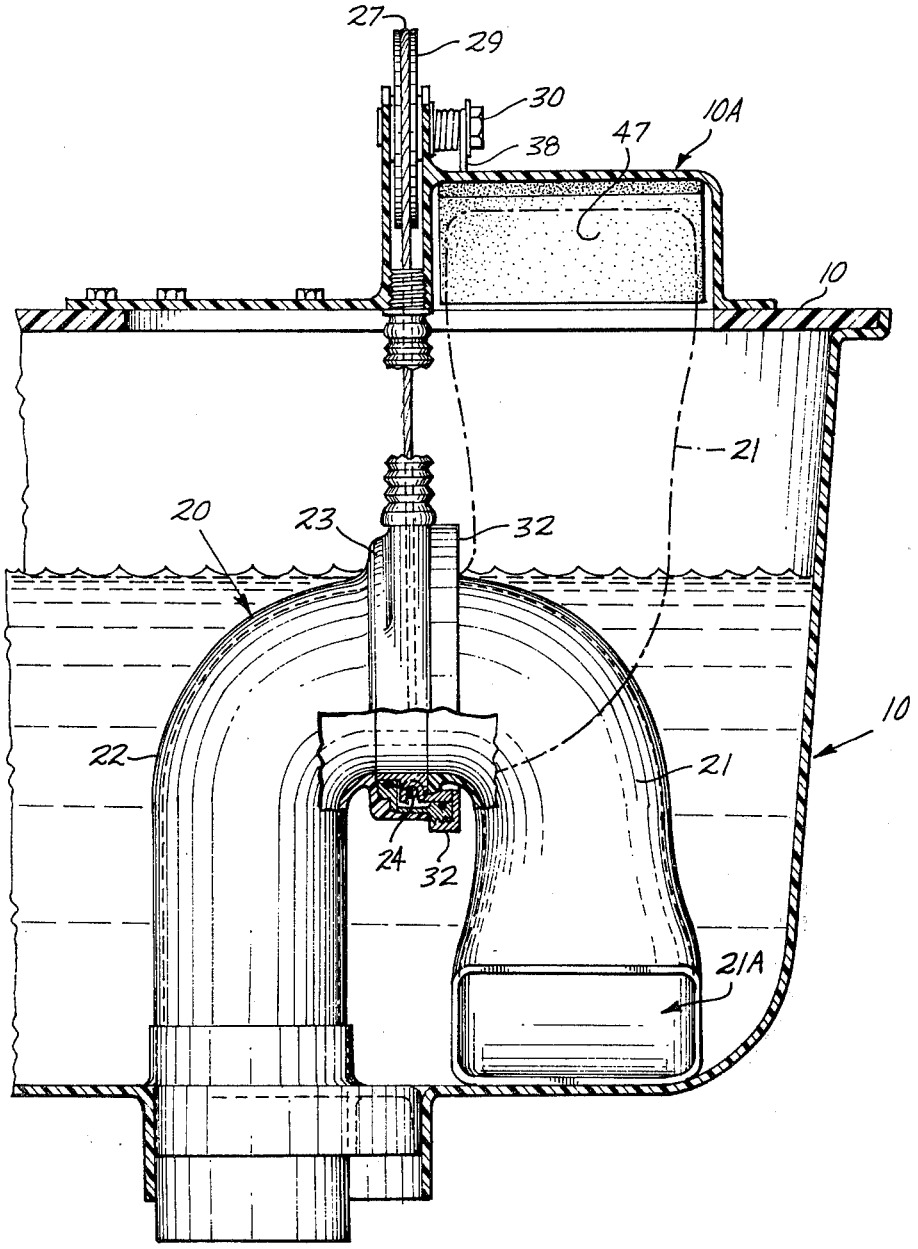
FIG. 3 is an enlarged front detail view of the inverted U-shaped drain valve mechanism, taken in the direction 3—3 indicated in FIG. 1.
Figure 4:
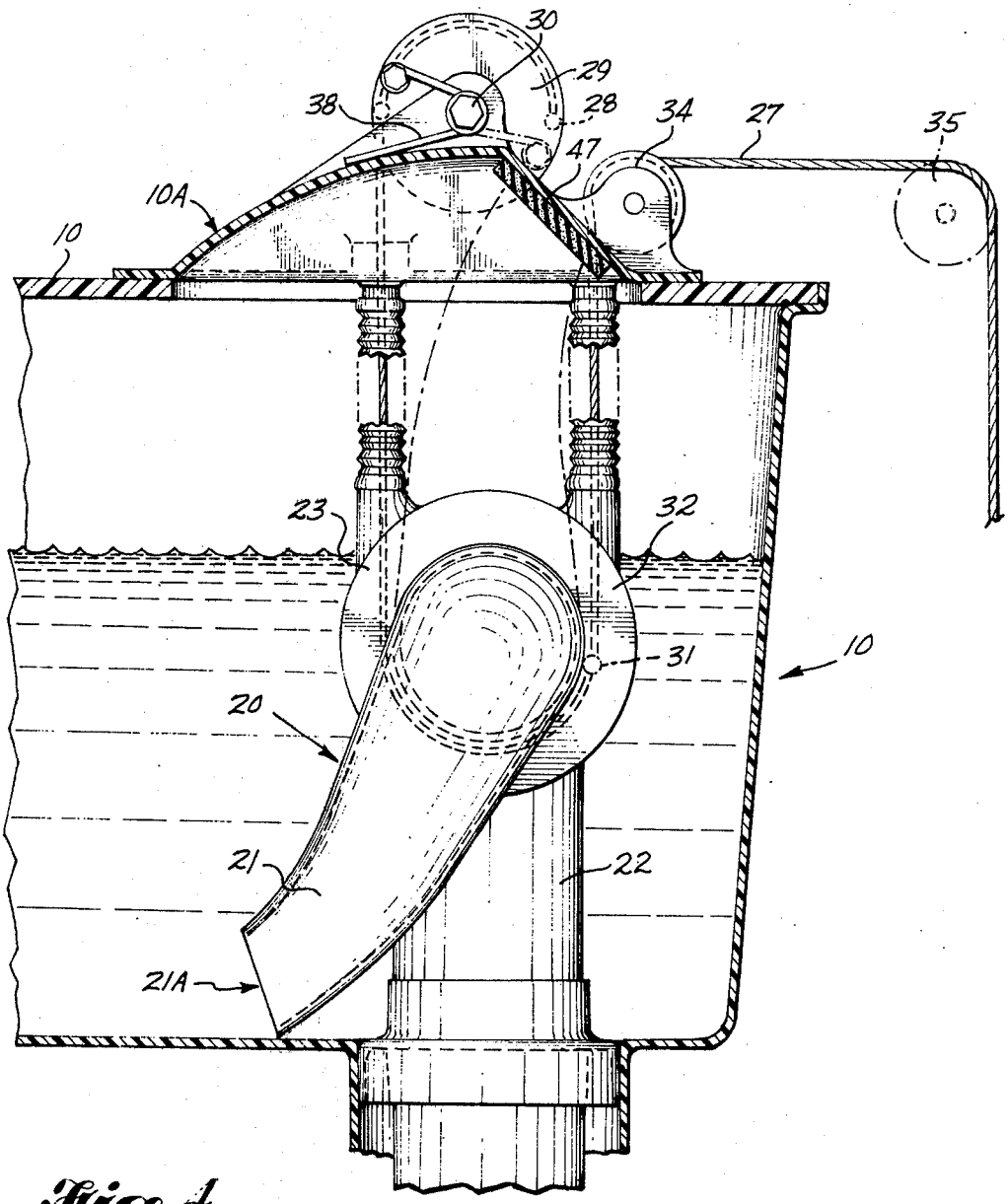
FIG. 4 is an enlarged side cross-sectional detail view of the inverted U-shaped drain valve mechanism shown in FIG. 1.

The waste drainage system within the interior of the waste holding tank 10, comprises an inverted U-shaped drain valve assembly 20 which is made into two halves or parts 21 and 22; and which are shown in enlarged detail in the plan view of FIG. 2, the front cross-section view of FIG. 3, and the side cross-section view of FIG. 4. The part 21 is movable rotatably with respect to the part 22 which is mounted rigidly within the tank. The part 21 is connected together with part 22 through a rotatable joint 23 having double O-ring seals 24 for providing a leakproof rotatable juncture.

As more clearly shown in FIGS. 2 through 4, a control cable 27 is fastened at one end 28 to the relatively large pulley 29 which is mounted at pivot 30 to the top of the tank 10; and the control cable 27 goes over the top of pulley 29 and down to and around the rotatable juncture 23, where it has a fixed connection at 31 to the rotatable ring part 32 of the inverted U-shaped drain valve 20. From the fixed connection 31, the control cable 27 goes up and over smaller pulleys 34, 35, and down to the service panel 14 where it is fastened at its other end to a drain valve control handle 37. The relatively large pulley 29 has a spring mechanism 38 which biases the rotatable part 21 of the inverted U-shaped drain tube valve 20 to rotate to the raised and closed position, shown in dash-dot outline in FIGS. 3 and 4, when the drain valve control handle 37 is released to return to the closed position. For readying the waste holding tank for the draining and flushing operation, the service attendant pulls out the drain valve control handle 37 whereby the control cable 27 rotates the drain intake nozzle 21 of the inverted U-shaped drain valve 20 from the raised, closed position to the down and open intake position, where the drain intake nozzle opening 21A is at the bottom of tank. The shape of the intake opening 21A and the scoop angle that the lower surface of the drain intake nozzle 21 makes with respect to the bottom of the waste holding tank 10, is of importance in completely emptying the tank. Because, the more tangent that the lower surface of the intake opening portion 21A of the drain intake nozzle 21 is to the bottom of the tank, the more complete will be the emptying action of the tank when vacuum suction is applied for waste removal. Also of importance is the height of the upper lip of the intake opening 21A and the sizing thereof; and this is more clearly seen in FIG. 3 wherein the intake opening 21A is shown as a rectangular shape. By having a relatively large flat surface portion lying on the bottom of the tank, the waste removing action is somewhat analogous to using a dust pan for sweeping up dirt, in that it is desirable to have fairly large and flat surface against the floor for a more rapid and complete take-up of the dirt.

The inverted U-shaped drain valve arrangement 20 of the present invention will also prevent overflow of the waste holding tank 10 during the ground servicing operation, in the event that too much fresh liquid is pumped back into the tank as the pre-charge for initiating toilet flushing operation. The manner in which this pre-charging is presently done, is that through the use of a flow meter on the ground servicing tank truck, a predetermined amount of pre-charge liquid is pumped into the waste holding tank; however, if the servicing attendant is lax or inattentive, it is possible to pump in an excessive amount or in some instances fill the tank to overflowing. However, with the present invention, the drain intake nozzle opening 21A is left in the down position after emptying the tank and the fresh liquid pre-charge is pumped into the tank 10 through the tank flush connection 40, tank flush line 41, check valve 42 and the tank spray ring 43. As the liquid level reaches the elbow of the inverted U-bend, any excess will spill over the crest thereof and flow out through the waste drain connection 45 comprising a handle and a hinged cap.

Referring to FIG. 4, as the drain intake nozzle 21 is rotated to the up position, the intake opening portion 21A enters into a recess 10A located in the upper surface of the tank. The purpose of this is to get the end closure or sealing point of the drain intake nozzle 21, above the level of the waste, in the event that the holding tank becomes full; so that, if the intake opening 21A does not close tightly and seal against the resilient stop 47, the leakage will be air and not liquid waste.

An analysis of the possible liquid leak paths, will show that if the drain cap 45 at the service panel 14 leaks and the drain intake opening 21A also leaks, then the leakage will be only air and not liquid waste. This makes the sealing function of the drain cap 45 and the tank drain valve not critical; since, any small amount or reasonable amount of leakage will be only air and not liquid waste. Also, this would eliminate the need for the so-called Do-Nut 49 as previously described.

To do a good job of emptying and cleaning out the waste holding tank 10 requires the use of vacuum pressure on the ground service tank truck. However, in the event that vacuum pressure is not available, the waste in the holding tank can be drained down to a fairly low level by a self-siphoning action. This is done by starting with the level of liquid waste above the elbow or the rotatable juncture 23 of the inverted U-shaped drain valve parts 21, 22, which if not there initially, can be accomplished by adding liquid through the tank flush connection 40 at the service panel 14, and then rotating the drain intake nozzle 21 to the down position; this will start a gravity siphoning action when the waste drain connection 45 is hooked up to the ground service tank truck. This gravity siphoning action will continue until the level of liquid waste reaches the upper lip of the drain nozzle intake opening 21A, at which time air will enter and stop the further removal of waste.

Figure 5:
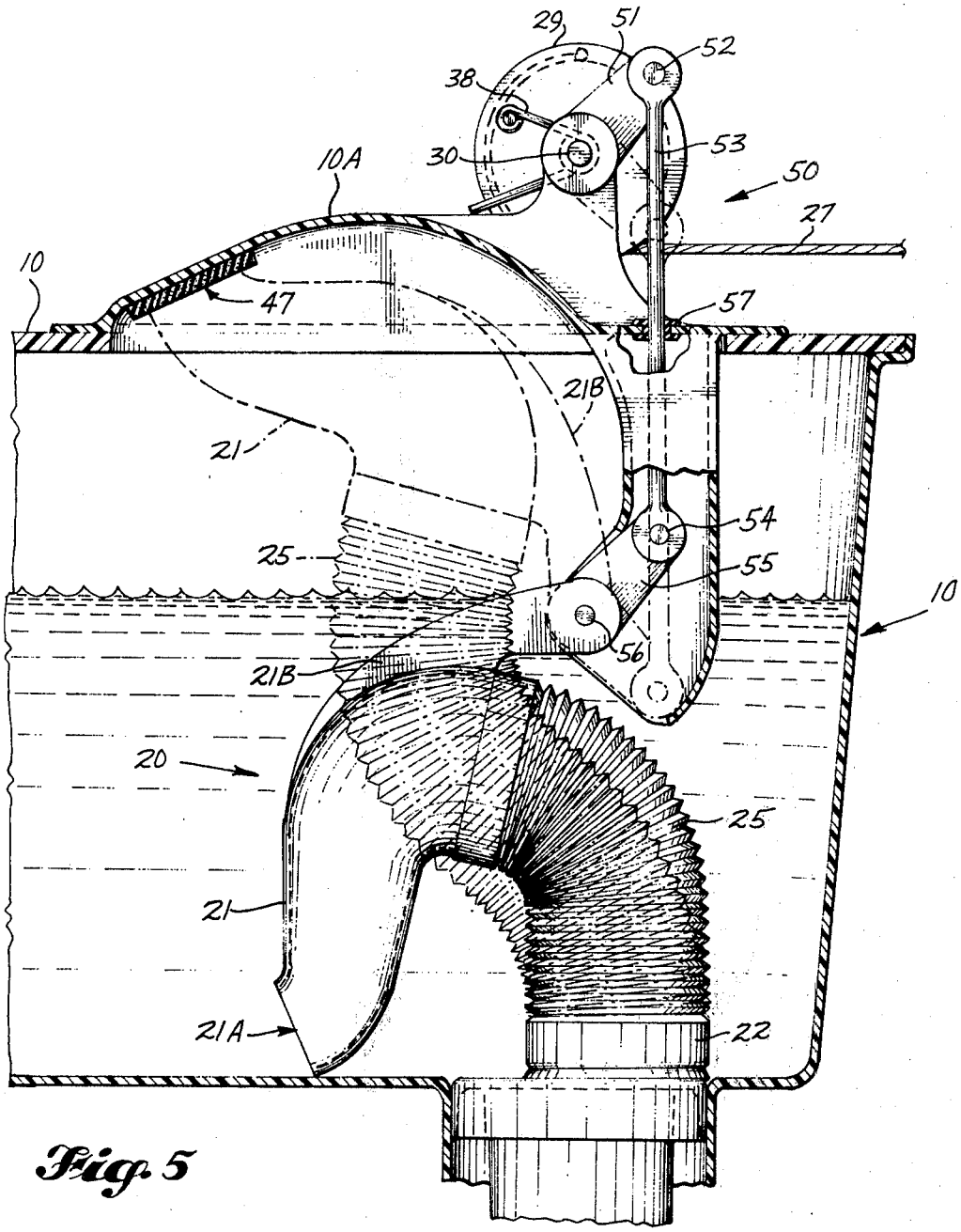
FIG. 5 is an enlarged side cross-sectional detail view, somewhat similar to that shown in FIG. 4, and shows a second embodiment of the inverted U-shaped drain valve mechanism incorporating a flexible connection at the bend of the U-shape, instead of the rotary joint shown in the first embodiment.

FIG. 5 is an enlarged side view somewhat similar to FIG. 4, and shows a second embodiment of an inverted U-shaped drain valve arrangement, wherein the juncture or elbow portion of the two parts of the inverted U-shape, comprises a flexible connection 25. Those elements which are similar to those previously described have been given like reference numerals and where there are some differences in the elements, they have been identified with different numerals or a letter suffix has been added.

The waste drainage apparatus in the enlarged detail side view of FIG. 5, comprises an inverted U-shaped tubular member 20 (as shown in solid outline) which is separated at the U-bend into approximately two parts 21 and 22, which are joined at their separation through a flexible tubing 25 having a relatively smooth interior surface to prevent waste buildup. The part 22 is affixed to the interior of the tank 10 and has its non-joined end projecting out from the bottom of the tank, forming the tank drainage opening. The part 21 forms the waste drain intake nozzle with the nozzle opening 21A at its non-joined end; and through the flex-tube connection 25, it is movable to a raised position (shown in dash-dot outline). An actuating mechanism 50 moves the intake nozzle 21 from its operative waste removal position (shown in solid outline) where the nozzle opening 21A is adjacent to the bottom of the tank, to the raised position whereat the intake nozzle opening 21A is in a closed abutment relationship with a resilient member 47 for a liquid sealing engagement therewith. The actuation of the intake nozzle 21 is through a cable 27 and pulley 29 operated linkage mechanism 50 which guides the movement in a vertical plane of the nozzle opening 21A. The actuating mechanism 50 comprises a relatively large pulley 29 which is mounted at pivot 30 to the top of tank 10; and mounted for rotation therewith is a driving arm 51. This driving arm 51 is pivotally connected at 52 to the upper end of a vertical rod or link 53, and the lower end of link 53 is pivotally connected at 54 to a driven arm 55. This driven arm 55 is pivotally supported at 56 to structure fixed to the interior of the tank 10 and is integrally movable with the intake nozzle 21, through an upright lug fitting or arm 21B which is formed integral with the intake nozzle 21. It will be noted that the driving arm 51, the link 53 and the driven arm 55, together form a parallel linkage arrangement; whereby, the link 53 moves vertically and slides through a grommet 57 supported in the top of the tank. The driving arm 51, through a spring mechanism 38 which biases the pulley 29 to rotate clockwise (as shown in FIG. 5), and likewise biases the drain intake nozzle 21 to rotate about pivot 56 to the raised and closed position, shown in dash-dot outline, when the attendant at the service panel releases the drain valve control handle 37 to return it to the closed position. To ready the waste holding tank for the draining and flushing operation, the attendant pulls out on the drain valve control handle 37, as was previously described with respect to the first embodiment; whereby, the control cable 27, which goes under and around over to the top of pulley 29 is affixed thereto, rotates the pulley 29 counterclockwise and lowers the drain intake nozzle 21 to its operative waste removal position, shown in solid outline, whereat the nozzle opening 21A is adjacent to the bottom of the tank.

This invention provides a sound technical solution to the problems associated with the sealing characteristics of the waste drain valves, regardless of how the toilet waste system is serviced, by providing a rotatable drain intake nozzle within the waste holding tank which moves the sealing point of the drain valve from the bottom of the tank to the top whereat the sealing characteristics of the drain valve are no longer critical.

While the invention has been disclosed with reference to presently preferred embodiments, it is to be understood that those modifications and changes which become obvious to a person skilled in the art as a result of the teachings herein, will be encompassed by the following claims.

What is claimed is:

1. Waste Drain valve mechanism for a water closet waste holding tank, comprising: an inverted U-shaped tubular member mounted within the tank and having one end affixed to and projecting out from the bottom of the tank, the other end being movable at the bend of the U-shape and having an intake nozzle opening; means for positioning said intake nozzle opening at the bottom of the tank for the operative waste removal position; apparatus under the control of an operator for removing waste under partial vacuum pressure through said intake nozzle opening; and means for positioning said intake nozzle opening to a raised position whereat the intake nozzle opening is at the top of the tank for preventing the removal of waste from the tank.

2. Waste drain valve mechanism for periodically draining the contents of a water closet waste holding tank, comprising: an inverted U-shaped tube mounted within the tank and being separated at the bend thereof into a first and a second part; a movable juncture formed between said first and second parts at their bend separation, for relative movement therebetween; said first part being affixed to the tank with its non-joined end projecting out from the bottom of the tank and forming a tank drainage opening; said second part being movable with respect of said first part and having an intake nozzle opening at its non-joined end; and means for moving said second part from an operative waste removal position whereat the intake nozzle opening is adjacent to the bottom of the tank, to a raised position whereat the intake nozzle opening is at a closed abutment position at the top of the tank for preventing the removal of waste from the tank.

3. Apparatus for periodically draining the contents of a water closet waste holding tank, comprising: an inverted U-shaped tube mounted within the tank and being separated at the bend of the U-shape into first and second parts; a movable connection joining said first and second parts, at their separation, for relative movement therebetween; said first part being rigidly fixed with respect to the tank and having its non-joined end projecting out from the bottom of the tank; said second part being movable with respect to said first part and having an intake nozzle opening at its non-joined end; means for moving said second part to a position whereat the intake nozzle opening is at the bottom of the tank for waste removal operation; and means for returning the intake nozzle opening of said second part from the bottom of the tank, to a raised position at the top of the tank for preventing the removal of waste from the tank.

4. Waste drain valve mechanism for periodically draining the contents of a water closet waste holding tank, comprising: an inverted U-shaped tubular member mounting within the tank and being separated at the bend thereof into approximately two half-parts; said two half-parts being joined together at the bend of the U-shape by a movable connection for relative movement therebetween; a first of said half-parts being affixed to the interior of the tank and having its non-joined end projecting out from the bottom of the tank and forming a drainage opening in the bottom thereof; apparatus under the control of an operator for removing waste under partial vacuum pressure through said drainage opening in the bottom of the tank; a second of said half-parts being movable with respect to said first half-part and having an intake nozzle opening at its non-joined end; means for moving the intake nozzle opening of said second half-part from its operative waste removal position at the bottom of the tank, to a raised position at the top of the tank for preventing the removal of waste from the tank.

5. A water closet system, comprising: a water closet bowl having a discharge opening; a storage tank situated below and immediately adjacent to said water closet bowl, and being in direct communication with the discharge opening thereof for receiving waste therefrom; a filtered liquid recirculating means mounted within the storage tank and having an inlet for withdrawing liquid from adjacent the bottom of the storage tank, and having an outlet for recirculating flush liquid from the storage tank to the water closet bowl; a movable drain outlet, comprising an inverted U-shaped drain valve which is one position is raised to the top of the tank above the waste level in the tank to prevent waste discharge, and which in the other position is lowered to the bottom of the tank so that waste is discharged; and means for rotating the intake nozzle from a sealed position at the top of the tank to an operative waste removal position at the bottom of the tank.

6. A water closet system, comprising: a water closet bowl having a discharge opening; a storage tank situated below and immediately adjacent to said water closet bowl, and being in direct communication with the discharge opening thereof for receiving waste therefrom; a pump-filter assembly mounted within the storage tank and having an inlet for withdrawing liquid from adjacent the bottom of the storage tank, and having an outlet for recirculating flush liquid from the storage tank to the water closet bowl; having a displaceable storage tank intake drain, an inverted U-shaped drain valve which for one location raises the tank intake drain to the top of the tank above the waste level in the tank to prevent waste discharge, and which for another location lowers the tank intake drain to the bottom of the tank so that waste is removed therethrough; actuating means for rotating the tank intake drain from a sealed position at the top of the tank to an operative waste removal position at the bottom of the tank; a service panel having a waste drain connection accessible from outside of the airplane for waste removal servicing of the tank; a main drain line communicating with said service panel waste drain connection and said tank discharge opening; a source of partial vacuum pressure for applying a suction force to the service panel waste drain line connection for sucking up the waste contents from the tank through the displaceable tank intake drain.

* * * * *